United States Patent [19]

Schlecht et al.

[11] Patent Number: 4,529,016

[45] Date of Patent: Jul. 16, 1985

[54] APPARATUS FOR INSERTING WEFT WIRES IN A WEAVING LOOM

[75] Inventors: Ludwig Schlecht, Walddorfhaslach; Peter Defranceski, Reutlingen, both of Fed. Rep. of Germany

[73] Assignee: Hermann Wangner GmbH & Co. KG, Fed. Rep. of Germany

[21] Appl. No.: 513,278

[22] Filed: Jul. 13, 1983

[30] Foreign Application Priority Data

Jul. 28, 1982 [DE] Fed. Rep. of Germany ..... 3228217

[51] Int. Cl.[3] ..... D03D 47/24; D03D 49/44

[52] U.S. Cl. ..... 139/438; 139/134; 139/196.2

[58] Field of Search ..... 139/438, 437, 439, 134, 139/196.2, 449

[56] References Cited

U.S. PATENT DOCUMENTS

| | | | |
|---|---|---|---|
| 3,114,398 | 12/1963 | Pfarrwaller | 139/134 X |
| 3,618,640 | 11/1971 | Linka | 139/134 |
| 3,636,989 | 1/1972 | Reiker et al. | 139/438 |

FOREIGN PATENT DOCUMENTS

| | | | |
|---|---|---|---|
| 908240 | 4/1954 | Fed. Rep. of Germany | 139/134 |
| 989730 | 5/1951 | France | 139/134 |
| 2372256 | 6/1978 | France | 139/134 |
| 1428164 | 3/1976 | United Kingdom | 139/134 |

*Primary Examiner*—James Kee Chi

[57] ABSTRACT

An apparatus for inserting weft wires in flat weaving power looms wherein a shuttle is moved by carriages which are disposed above and below the shed defined by the warp wires and which are guided by magnetic means and wherein the shuttle is a gripper shuttle, the shuttle and the carriages include permanent magnets, and the drive means for the carriages is one of a stepping motor, a speed-controlled three-phase current motor and a disk rotor motor which effects positioning of the carriages and thus of the gripper shuttle at the weft transfer points by a holding force.

18 Claims, 3 Drawing Figures

APPARATUS FOR INSERTING WEFT WIRES IN A WEAVING LOOM

BACKGROUND OF THE INVENTION

This invention relates to an apparatus for inserting weft wire in flat weaving power looms.

German Patent No. 908,240 discloses a weft insertion apparatus wherein a shuttle is disposed within the shed defined by the warp wires. Carriages are guided above and below the shed and drag the shuttle by magnets. These carriages, in turn, are reciprocally driven by a drive means connected thereto.

In the apparatus of the aforesaid patent, the shuttle is further equipped with a weft bobbin so that the shuttle is of large mass and, therefore, requires large acceleration forces. This, in turn, necessitates that the magnets also be large and thus heavy. As a result, the number of picks per minute of the apparatus is limited. Furthermore, at the ends of the path of motion, the shuttle of the apparatus enters shuttle boxes and is no longer under magnetic influence. Mechanical means is therefor additionally needed for better acceleration of the shuttle out of the boxes.

Weft insertion apparatuses are also known in which a shuttle is dragged by only one carriage which is arranged below the shed and is guided by magnetic forces (See, e.g, German Patent No. 211,916 and German published applications (OS) 1,785,147, 2,211,491, and 2,311,780). It is a disadvantage of these arrangements that the shuttle rests directly on the warp wires so that the wires are subjected to forces corresponding to not only the weight of the shuttle but also to the magnetic forces exerted on the shuttle. This is likely to cause damage to the warp wires and high wear of the shuttle.

British patent application No. 2,020,706 discloses a weft insertion apparatus wherein the shuttle is moved through the shed by a linear motor. In this case, in order to avoid excessively high pressing pressure, the stator is divided into two parts between which the shuttle moves. However, when using such a linear motor it is not possible to reach an acceleration sufficiently high to permit a number of picks higher than that reached with mechanical picker means.

It is an object of the present invention to provide an improved apparatus for inserting weft wires so that higher number of picks is attainable.

SUMMARY OF THE INVENTION

In accordance with the principles of the present invention, the above and other objectives are realized in a weft insertion apparatus of the type disclosed in the '240 patent wherein the shuttle is a gripper shuttle, the magnetic means comprises permanent magnets disposed in the shuttle and carriages, and the drive means comprises one of a stepping motor, a speed-controlled three-phase current motor and a disk rotor motor, the holding force of the drive means being used to position the carriages and, therefore, the shuttle.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
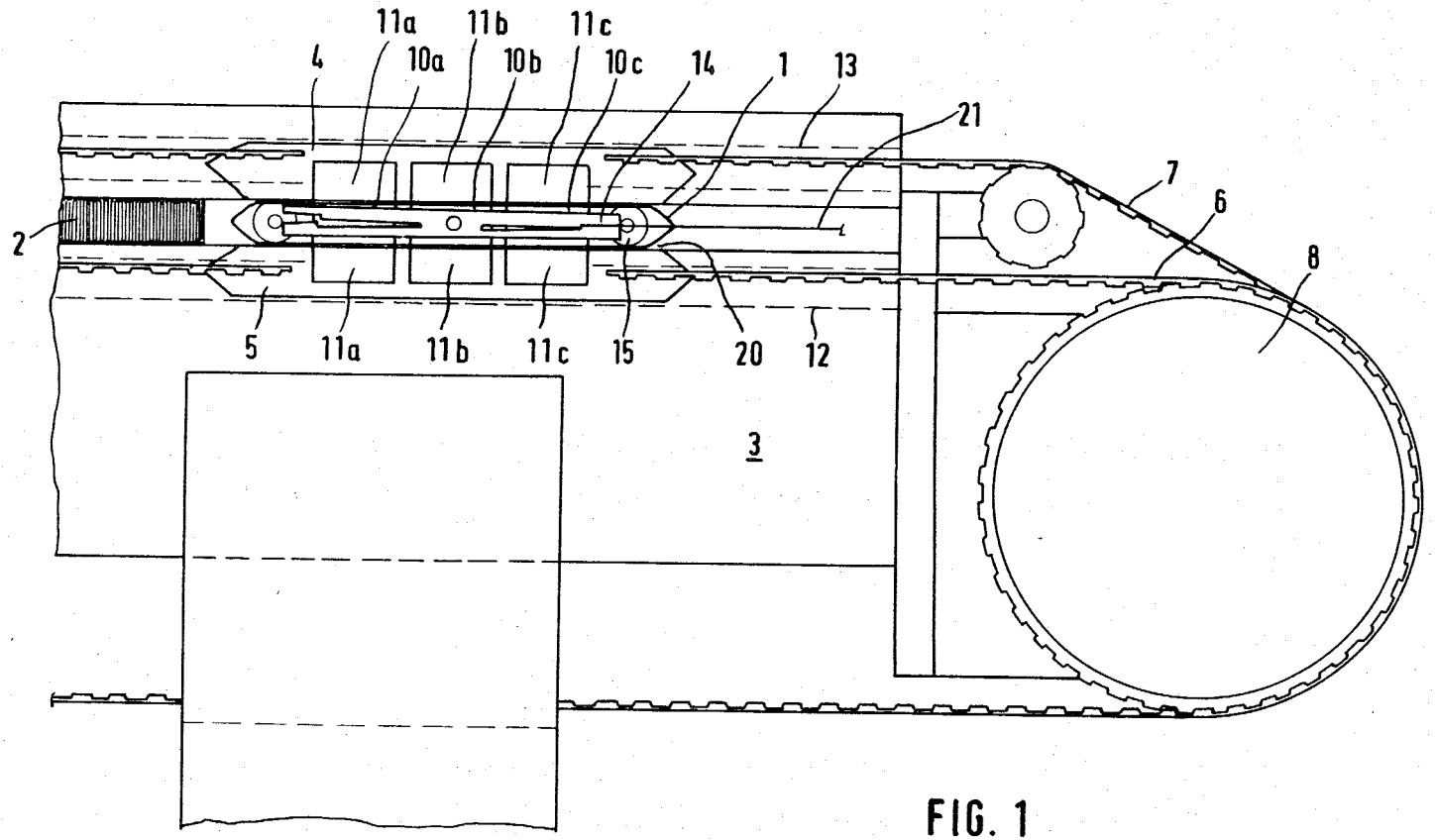
FIG. 1 shows a sectional view taken across the warp wires of a weft insertion apparatus in accordance with the principles of the present invention.

In FIG. 1, the weft insertion apparatus of the invention comprises a gripper shuttle 1 which moves in a shed or enclosure formed by the warp wires being woven in a power loom comprising a loom sley 3. The loom sley 3 and its driving means are of conventional construction so that these elements need not be described in greater detail.

The gripper shuttle 1 is moved by magnetic forces exerted by carriages 4, 5 arranged above and below the shed, respectively. The carriages 4, 5 are driven, in turn, by a drive means 9 which, in accordance with the invention, may be a stepping motor, a speed controlled three-phase currrent motor or a disk rotor motor. As shown, the drive means 9 is a stepping motor.

The power exerted by the drive means is coupled to the carriages via toothed belts 6, 7 clamped at the leading and the trailing end of the carriages 4, 5 respectively, and by way of a gear 8. The use of toothed belts in conjunction with the specified drive means permits precise positioning of the carriages and thus of the gripper shuttle at the weft transfer point. Toothed belts are preferred on account of their minimal elongation, although chains and cables might also be used.

The gripper shuttle 1 preferably has a plurality of permanent magnets (shown as three in the drawings) 10*a, b, c* each of which might have a 20 to 24 mm diameter. Preferably, the magnets 10*a, b, c* have alternately opposite magnetic orientation. The upper and the lower carriages 4, 5 also each contain a corresponding number of permanent magnets (three in this case) 11*a, b, c,* each of which also might be 20 to 24 mm diameter.

The magnets of the carriages 4, 5 are in registry with the permanent magnets 10*a, b, c* of the gripper shuttle 1 and have like orientation. The permanent magnets 11*a, b, c* of the carriages thus also have alternately opposite magnetic orientation. As a result, unlike magnetic poles of the shuttle and carriages oppose or face each other so that the shuttle 1 is attracted by each of the carriages. The magnets 10*a, b, c* and 11*a, b, c* are identified in FIG. 2 by the numerals 10 and 11, respectively. The magnets might be high remanence permanent magnets and a suitable magnetic material is samarium cobalt.

Figure 2:
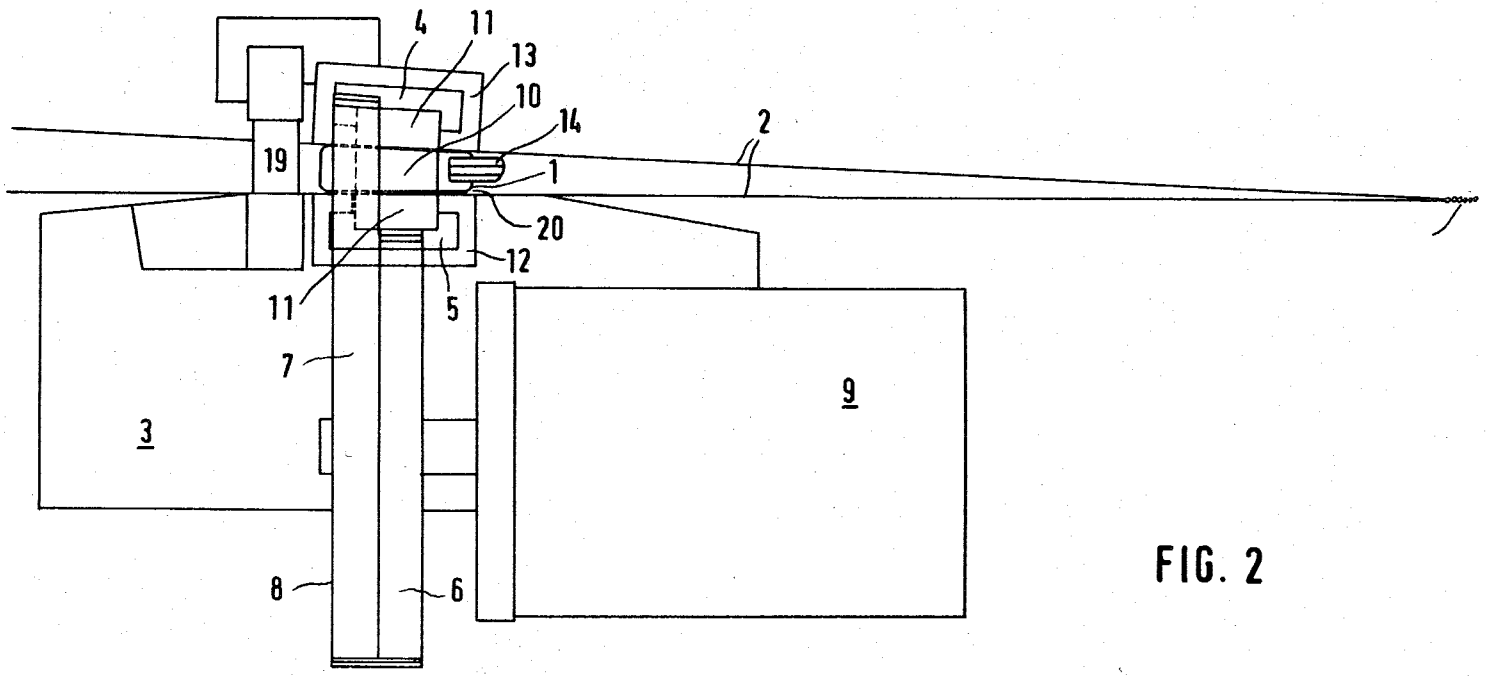
FIG. 2 shows a sectional view taken along the warp wires of the apparatus of FIG. 1.
Figure 3:
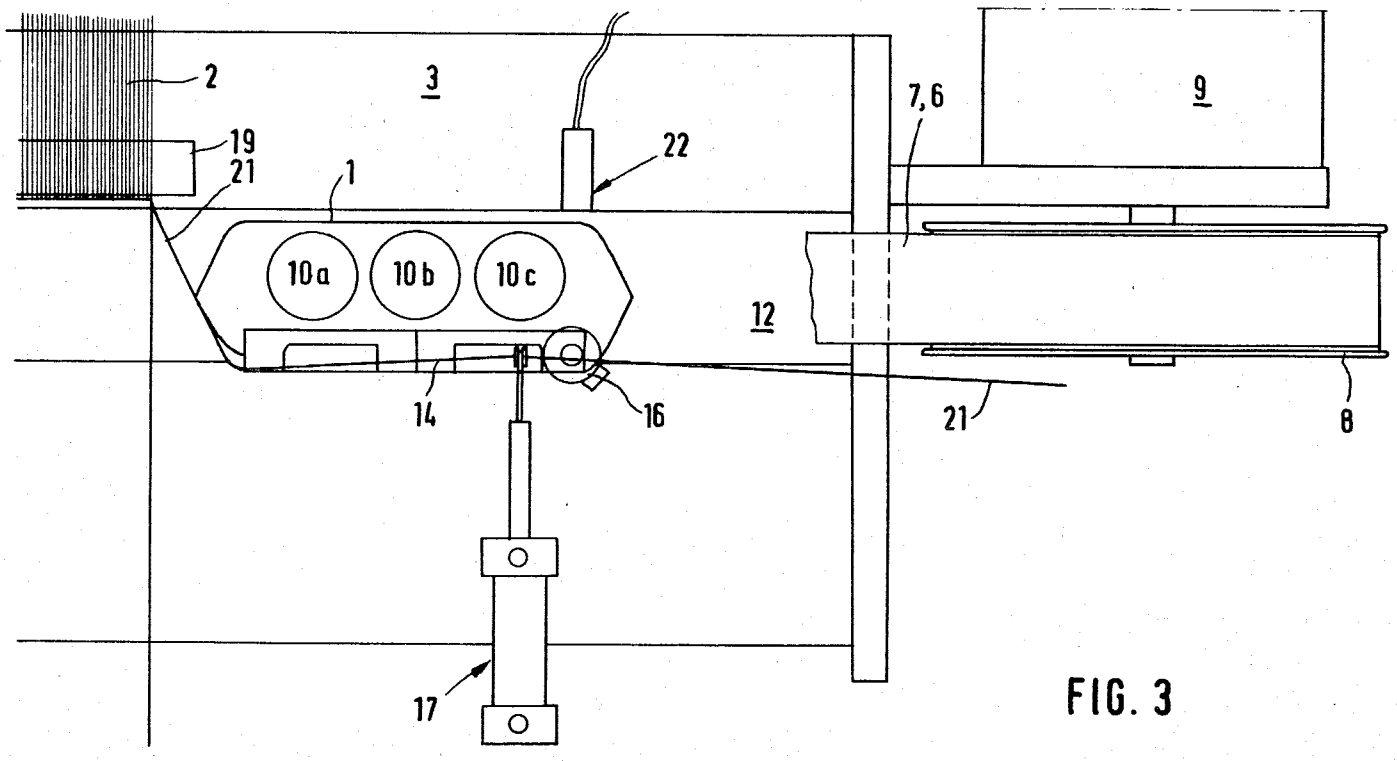
FIG. 3 is a plan view of the gripper shuttle of the apparatus of FIG. 1 in one of its end positions.

The carriages 4, 5 slide in rails 12, 13. The rail 12 guiding the lower carriage 5 protrudes into the top side of the loom sley 3 and has a C-shaped profile open at the top, as is shown in FIG. 2. This enables the rail to positively guide the lower carriage 5 in the lateral as well as in the vertical direction. The upper carriage 4 is guided in a corresponding rail 13 which also has a C-shaped profile, but which is open at the bottom. The upper support of the reed 19 serves at the same time to support upper rail 13.

For a given number of picks, it is especially significant to minimize any moving masses of the insertion apparatus and, in particular, those of the carriages 4, 5 and the gripper shuttle 1. In contrast with mechanical picker devices wherein very heavy shuttles—normally they have a mass of 4 kg—are employed in order that they have sufficient energy to impart dragging motion, the gripper shuttle 1 of the invention preferably has a mass of less than 500 grams and, more preferably, one of less than 200 grams.

Since the gripper shuttle 1 has only about one tenth of the weight of a gripper shuttle used in a mechanical devices, namely less than 500 grams, it may be of flat construction which results in a narrow shed opening angle and thus in a low height of the reed 19. The reed 19 thus becomes more stable and can be more easily used as a support and as a means for holding the upper rail 13.

The rails 12 and 13 can be made of polyethylene as can the running faces of the carriages 4, 5 so as to reduce friction. The rails 12, 13 are spaced apart a distance so that there is an air gap 20 of about 0.7 to 1 mm between the lower carriage 5 and the upper carriage 4, on the one hand, and the gripper shuttle 1, on the other hand. This gap is about 0.1 to 0.2 mm wider than the diameter of the warp wires 2 and forms an air cushion during the movement of the gripper shuttle 1. Contact between the gripper shuttle 1 and the warp wires 2 is thereby largely prevented. The gripper shuttle 1 also is provided with rollers which reduce friction at speeds of the shuttle which are insufficient to build up a sufficient air cushion.

As above-noted, the two carriages 4, 5 are moved in synchronism by way of the toothed belts 6, 7. The toothed belts 6, 7 are trained over gears arranged laterally at the loom sley 3. While the gear 8 on one side idles, the gear 8 on the other side is driven by the drive means 9. The drives means 9 is controlled by a conventional microprocessor (not shown).

For a gripper shuttle 1 weight of 250 grams, a drive means 9 having a power output of 250 watts is sufficient to drag the gripper shuttle through a shed of 10 meters width in 1 second. The drive means 9 permits uniform acceleration and uniform deceleration of the gripper shuttle 1. At the same time, it permits a precise positioning of the gripper shuttle 1 at the weft transfer point. With a 10,000 cps current source positioning accuracy is less than 2 mm.

The gripper bill 14 of the gripper shuttle 1 is of conventional design and is actuated pneumatically or electrically in the customary manner by a gripper changeover cylinder 16.

Shuttle boxes are not necessary in the apparatus of FIG. 1, since, at the two shuttle end positions, i.e, during weft transfer, the gripper shuttle 1 is held by the carriages 4, 5. The weft wire 21 is held in readiness by one or more weft wire feeders 17 which are retractable and extensible and are arranged on both sides of the power loom. In the present embodiment, the gripper bill 14 is held in its open and closed positions by permanent magnets. Also, a contactless switch 22 on each side of the loom checks whether the gripper shuttle 1 has reached its end position at which weft transfer takes place.

Operation of the insertion apparatus of the invention under microprocessor control is as follows. When during its movement toward the harness, the loom sley 3 has almost reached the point of reversal, a control pulse is contactlessly generated at a position of the crankshaft reached at that instant. This control pulse actuates an accordingly programmed control circuit which inputs into the drive means 9 connected thereto the number of revolutions, the desired acceleration, the maximum speed per unit of time, and the deceleration. When the shuttle 1 has reached its end position and the drive means 9 has reached the energized rest condition, a large holding force is imparted to the drive means 9 (about as high as the maximum torque) so that the drive means locks itself and thus locally fixes the shuttle 1 in its momentary end position.

When during its movement toward the heald the loom sley 3 has again nearly reached the point of reversal, a control pulse is again contactlessly generated. This pulse triggers the drive means—this time in reversed sense of rotation. This effects insertion of the next following weft wire. Preferably the shuttle 1, as above-mentioned, is linearly accelerated and linearly decelerated. However, the acceleration and deceleration need not be linear. Perfect arrival of the shuttle in the respective end position is additionally monitored by the contactless switches 22. If the shuttle 1 does not arrive at its end position due to a disturbance, the machine automatically ceases operation.

The weft insertion apparatus of the invention has significant advantages over mechanical apparatuses. Thus, the subject invention requires no picker assembly with picking shaft, underpick picker, overpick picker and picker, no shuttle boxes and no latch. Moreover, the loom sley can be about 1 m shorter and the shuttle may be very flat so that the shed height may be reduced. This, in turn, results in lesser warp wire tension differences during change of shed and a smaller shaft stroke of 50 to 70 mm and, as a consequence, the possibility of more rapid change of shed. The smaller height of the shed also implies a smaller shed opening angle so that a greater number of heald frames can be provided.

Moreover, with the present apparatus, the tension exerted on the filling may be monitored during the entire weft insertion. The stress peaks of the weft wire are in any case attenuated, owing to the lower weight of the shuttle and the relatively flexible coupling between the shuttle and the carriages.

The magnetic forces exerted in the present insertion apparatus can be so selected that the gripper shuttle 1 leaves the magnetic field between the carriage 4, 5 and falls behind when the tension exerted on the weft wire becomes excessively high. Of course, there is no wear on the reed by the shuttle 1 because it no longer slides along the reed and thus cannot cause any wear. Owing to the lower shed height also the reed can be made lower and thus stronger. Moreover, the weft inserion apparatus of the invention operates with substantially less noise than a picker. On account of the smaller gripper shuttle the weft ends are shorter and weft material can be saved.

Finally, the weft insertion apparatus of the invention is especially advantageous for power looms exceding 5 meters fabric width. This is so because in looms of such width the time required for acceleration and deceleration of the gripper shuttle is less in proportion to the time of travel of the gripper shuttle through the shed than it is in narrower looms. The wider the loom the higher grows the possible increase in loom cycles as compared with conventional structures.

In all cases, it is understood that the above-described arrangements are merely illustrative of the many possible specific embodiments which represent applications of the present invention. Numerous and varied other arrangements can be readily devised without departing from the spirit and scope of the invention.

What is claimed is:

1. An apparatus for inserting weft wires in flat weaving power looms comprising:

a gripper shuttle adapted to pass through the shed defined by warp wires; carriages adapted to be guided above and below said shed for dragging said gripper shuttle by permanent magnets disposed in said shuttle and in said carriages, respectively; and a stepping motor and means connecting said stepping motor to said carriages for reciprocally driving said carriages, the holding force of said stepping motor positioning said carriages and thereby said gripper shuttle during weft transfer; and said gripper shuttle and said carriages being of lightweight construction.

2. Apparatus in accordance with claim 1 wherein: said carriages are spaced from said gripper shuttle to define an air gap of 0.7 to 1.0 mm width.

3. Apparatus in accordance with claim 1 wherein: said gripper shuttle has a weight of less than 250 grams.

4. Apparatus in accordance with claim 1 wherein: said permanent magnets contain samarium cobalt as magnetic material.

5. Apparatus in accordance with claim 2 wherein: said permanent magnets contain samarium cobalt as magnetic material.

6. Apparatus in accordance with claim 3 wherein: said permanent magnets contain samarium cobalt as magnetic material.

7. An apparatus for inserting weft wires in flat weaving power looms comprising:

a gripper shuttle adapted to pass through the shed defined by warp wires; carriages adapted to be guided above and below said shed for dragging said gripper shuttle by permanent magnets disposed in said shuttle and in said carriages, respectively; and a speed-controlled three-phase current motor and means connecting said speed-controlled three-phase current motor to said carriages for reciprocally driving said carriages, the holding force of said speed-controlled three-phase motor positioning said carriages and thereby said gripper shuttle during weft transfer; and said gripper shuttle and said carriages being of lightweight construction.

8. Apparatus in accordance with claim 9 wherein: said carriages are spaced from said gripper shuttle to define an air gap of 0.7 to 1.0 mm width.

9. Apparatus in accordance with claim 7 wherein: said gripper shuttle has a weight of less than 250 grams.

10. Apparatus in accordance with claim 7 wherein: said permanent magnets contain samarium cobalt as magnetic material.

11. Apparatus in accordance with claim 8 wherein: said permanent magnets contain samarium cobalt as magnetic material.

12. Apparatus in accordance with claim 9 wherein: said permanent magnets contain samarium cobalt as magnetic material.

13. An apparatus for inserting weft wires in flat weaving power looms comprising:

a gripper shuttle adapted to pass through the shed defined by warp wires; carriages adapted to be guided above and below said shed for dragging said gripper shuttle by permanent magnets disposed in said shuttle and in said carriages, respectively; and a disk motor and means connecting said disk motor to said carriages for reciprocally driving said carriages, the holding force of said disk motor positioning said carriages and thereby said gripper shuttle during weft transfer; and said gripper shuttle and said carriages being of lightweight construction.

14. Apparatus in accordance with claim 13 wherein: said carriages are spaced from said gripper shuttle to define an air gap of 0.7 to 1.0 mm width.

15. Apparatus in accordance with claim 13 wherein: said gripper shuttle has a weight of less than 250 grams.

16. Apparatus in accordance with claim 13 wherein: said permanent magnets contain samarium cobalt as magnetic material.

17. Apparatus in accordance with claim 14 wherein: said permanent magnets contain samarium cobalt as magnetic material.

18. Apparatus in accordance with claim 15 wherein: said permanent magnets contain samarium cobalt as magnetic material.

* * * * *